US008177463B2

(12) United States Patent
Walker

(10) Patent No.: US 8,177,463 B2
(45) Date of Patent: May 15, 2012

(54) SYSTEM FOR CONNECTING AND DISCONNECTING CONTAINERS FROM A BASE

(76) Inventor: Peter J Walker, Westport, CT (US)

( * ) Notice: Subject to any disclaimer, the term of this patent is extended or adjusted under 35 U.S.C. 154(b) by 0 days.

(21) Appl. No.: 13/044,239

(22) Filed: Mar. 9, 2011

(65) Prior Publication Data

US 2011/0217139 A1 Sep. 8, 2011

Related U.S. Application Data

(63) Continuation of application No. 12/383,302, filed on Mar. 23, 2009, now abandoned.

(60) Provisional application No. 61/123,535, filed on Apr. 8, 2008.

(51) Int. Cl.
*B60P 7/00* (2006.01)

(52) U.S. Cl. ..... 410/84; 410/32; 410/82

(58) Field of Classification Search ..... 410/31, 410/32, 34, 68, 69, 76, 80, 82, 84; 24/287; 294/81.5, 81.52, 81.53; 248/500, 503
See application file for complete search history.

(56) References Cited

U.S. PATENT DOCUMENTS

| | | | | |
|---|---|---|---|---|
| 3,015,407 | A | | 1/1962 | Fesmire et al. |
| 3,493,258 | A | | 2/1970 | Wyrough |
| 3,501,193 | A | | 3/1970 | Gray |
| 3,552,557 | A | | 1/1971 | Green |
| 3,633,777 | A | | 1/1972 | Snelling et al. |
| 3,677,599 | A | | 7/1972 | Shannon |
| 3,691,595 | A | | 9/1972 | Backteman et al. |
| 3,712,661 | A | | 1/1973 | Strand |
| 3,734,308 | A | | 5/1973 | Pasternack |
| 3,888,536 | A | | 6/1975 | Durenec |
| 3,980,185 | A | | 9/1976 | Cain |
| 4,093,090 | A | | 6/1978 | Whiteman |
| 4,149,747 | A | | 4/1979 | Portz et al. |
| 4,341,495 | A | | 7/1982 | Del-Acqua |
| 4,356,145 | A | | 10/1982 | Brandes et al. |
| 4,630,856 | A | | 12/1986 | Peeters Weem et al. |
| 4,648,645 | A | | 3/1987 | Lundgren |
| 5,163,726 | A | | 11/1992 | Boos et al. |
| 5,931,617 | A | * | 8/1999 | Kroll et al. ..... 410/91 |
| 6,135,524 | A | | 10/2000 | Faller et al. |

(Continued)

FOREIGN PATENT DOCUMENTS

| | | |
|---|---|---|
| DE | 2054868 | 5/1971 |

(Continued)

*Primary Examiner* — Stephen Gordon
(74) *Attorney, Agent, or Firm* — Pepper Hamilton LLP

(57) ABSTRACT

A system for locking and unlocking containers to transport modes and other containers comprises an actuating unit in an upper corner fitting of a container, a mechanical connecting mechanism connected to the actuating unit, and guides to route the connecting mechanism from the actuating unit to a rotatable locking leg housed in a lower corner fitting of the container. The twist lock of a lifting spreader engages the upper corner fitting of a container, urging the actuating unit. The connecting mechanism is in turn urged thereby causing the locking leg to rotate. The locking system, and apparatus to unlock a container twistlock, comprises in addition to an actuating unit, a locking mechanism in a lower corner fitting of the container, and a vertical coupler connecting the actuating unit with the locking mechanism. A torsional force applied to rotate the actuating unit is converted to a tension force by the actuating unit to move the vertical coupler, thus resulting in the rotating and unlocking of the locking mechanism.

19 Claims, 10 Drawing Sheets

U.S. PATENT DOCUMENTS

| | | | |
|---|---|---|---|
| 7,014,234 | B2 | 3/2006 | Walker |

FOREIGN PATENT DOCUMENTS

| | | | |
|---|---|---|---|
| GB | 2048821 | A | 12/1980 |
| JP | 2-178193 | A | 7/1990 |
| JP | 3-216485 | A | 9/1991 |
| SU | 654531 | | 3/1979 |
| SU | 802163 | | 2/1981 |
| SU | 812690 | | 3/1981 |
| SU | 819040 | | 4/1981 |
| SU | 927718 | | 5/1985 |
| SU | 1726356 | | 4/1992 |
| WO | WO 85/00578 | | 2/1985 |

* cited by examiner

SYSTEM FOR CONNECTING AND DISCONNECTING CONTAINERS FROM A BASE

CROSS-REFERENCE TO RELATED APPLICATIONS

This application is a continuation application of U.S. patent application Ser. No. 12/383,302, filed Mar. 23, 2009, now abandoned, which claims the benefit of U.S. Provisional Patent Application Ser. No. 61/123,535, filed Apr. 8, 2008 by the present invention. These applications are incorporated herein by reference in their entirety.

FIELD OF INVENTION

This invention relates generally to the locking of shipping containers. More particularly, this invention relates to a mechanism for connecting and disconnecting bulk containers to a base, such as, but not limited to, chassis, railcars, ship hatches, airline cargo decks, terminal decks and other containers.

BACKGROUND

When transporting or stacking bulk containers a locking device is needed to secure the containers to a base. The base could be an integral part of a transport vehicle, such as: truck chassis, railcar, aircraft, or ship hatch. Additionally, a base could be an adjacent container, when the containers are stacked onboard ships, rail cars, or in container yards. These locking devices are numerous including: cones, twist locks, lashing bars and other systems. Although these devices and systems are currently used to connect containers to various bases, they posses a number of disadvantages that make them unsafe and inefficient.

Currently a device called a cone is used when connecting containers to a ship's hatch or other containers. Cones come in three forms, manual cones, automatic cones and below deck cones. Cones are generally two tetrahedron shaped objects wherein the bases of the tetrahedrons are rectangular in shape and the bases of the tetrahedrons are base to base, such that the cones, when in an unlocked position, are in the shape of an octahedral diamond. At least one of the tetrahedrons can rotate such that the bases are no longer aligned, and when inserted between container corner castings can connect containers.

Manual cones are inserted into corner castings of a container that will connect to a ship hatch or another container. These cones are inserted into the corner castings manually when a lifting device raises the container off a chassis. The cone is inserted into the corner casting access slot of a container; and the head that is in the access slot is manually turned such that the head is locked into the corner casting. Once the cones are inserted in all four lower corner castings the container is lifted to its position on the ship and lowered onto the deck or another container where the bottom head of the cone mates with the deck or upper corner fittings of a lower container. The bottom head is then manually turned such that the head is locked into the corner casting thereby locking the container to a base.

Manual cones have a number of disadvantages. Cones require manual locking and unlocking, incurring additional labor costs and placing humans in potentially dangerous situations. Additionally, they require personnel to work both on vessels and on the ground, again increasing labor costs. Laborers are required to work around and beneath suspended containers, which weigh many tons even when empty. In addition, when cones are not inserted or turned into the locking position they can become detached from a container causing additional problems, such as an unsecured connection between a container and a base or, when being hoisted by a lifting device, the cone can fall from the container, injuring or killing personnel. Further, a cone is one form of a number of similar locking devices used to secure containers, such that additional equipment and additional purchase and maintenance costs are incurred. Lastly, recent U.S. regulations have required that all cones used at U.S. ports be of the automatic type due to safety considerations, causing the manual cones to be unsuitable for use in the U.S.

Automatic cones are similar to manual cones in design however, when the automatic cones are mated to a base they lock automatically. Although automatic cones eliminate the need to manually lock containers to a base, they still require a manual release, still placing personnel into dangerous work environments. For instance, containers are often stacked five, six or even seven high on board ship hatches, requiring personnel to work at great heights. Furthermore, automatic cones have a number of the disadvantages that manual cones posses, including: requiring personnel to work both on vessels and on the ground, the cones can fall free injuring or killing personnel below, and an automatic cone is one form of a number of similar locking devices used to secure containers such that additional equipment and therefore additional purchase and maintenance costs are incurred.

The twist lock is yet another device that is used to connect containers to a chassis. Twist locks are comprised of a locking pin and a handle. The locking pin has a shaft that runs through the bolster of a chassis, which can rotate. The locking pin also has a head which is rectangular in shape at its base and is cone shaped at its top. Bulk containers have corner castings with access slots at their top and bottom such that when the container is mounted on a chassis the head of the twist lock can mate with the access slot. The access slot is an opening in the corner casting of a container with which the pin head can mate when the pin head is in an open position but cannot mate or disconnect when the pin is in a locked position. When the locking pin mates with the corner casting, a handle connected to the shaft of the locking pin is manually turned, which in turn, twists the pin head inside of the corner casting such that the base portion of the pin head connected to the shaft is now askew in relation to the opening in the corner casting access slot, such that the container cannot be disconnected from its base.

Although twist locks address some of the limitations of the previous devices, they also posses a number of disadvantages. Still, the system requires a person to manually open and close the twist locks in order to connect or disconnect a container from its transport base. The manual requirement can put a person in a dangerous work environment where heavy machinery is lifting tons of equipment thereby putting an individual at risk of injury or death.

A second disadvantage of twist locks is the procedures that are adopted to prevent personnel from having to unlock containers from their bases in dangerous environments. A common practice is to require personnel to unlock containers from a chassis as the container enters a yard to prevent them from having to do so around heavy machinery or suspended containers. This method can create a number of dangerous situations in a yard. First, the container is no longer connected to the chassis, it is merely resting on the chassis. If an accident were to occur, the container is not connected to chassis, causing an unpredictable and potentially dangerous situation. Additionally, while driving around a yard, the twist locks often turn accidentally into the locked position requiring the driver to exit the safety of his vehicle to reopen the twist lock, thereby defeating the goal of the procedure. It is not uncommon for lifting devices, such as top picks and cranes, to drag or lift the truck along with the container. These are dangerous situations for drivers and anyone else that might be in the area. A third disadvantage is that a twist lock is again one form of a number of similar locking devices used to secure containers such that additional equipment and therefore additional purchase and maintenance costs are incurred.

Another disadvantage of current methods of securing containers to transport modes relates to the rail industry. When containers are stacked one or two high on rail cars, the lower container simply sits in the well of the rail car and has no means of being connected to the car. This is because there is no way to access the lower corner fittings of a container that is sitting in the well of the rail car. As a result, there is no way to manually unlock a manual or automatic cone or twist lock.

An additional disadvantage of these devises is the number of different locking devices utilized to perform a single function, connecting or disconnecting container from a base. A single, fully automatic, device should be used to connect containers to chassis, railcars, ship hatches or other containers to improve safety and efficiency between different transport modes.

Another disadvantage of these devices is that they adversely effect crane cycle times by 15 to 20% during vessel loading and discharging operations.

Inventions have been developed to overcome the above mentioned problems including Del Aqua's in 1982 (U.S. Pat. No. 4,341,495) and Cain's in 1976 (U.S. Pat. No. 3,980,185) These prior art forms however were not commercially viable; because the components of the inventions are intrusive into the interior space of a container, susceptible to being damaged by equipment or cargo moving into and out of containers, and would require modifications to the doors of a container. Also, these inventions require all four upper corner castings of a container to be engaged by rotatable twist locks of a spreader which is not possible when using machines which only engage two of the upper corner castings or sites that use fork lifts to lift containers. Lastly, the number of moving parts that comprise these are forms would be difficult and expensive to maintain in a fleet of containers spread around the world. In another invention by Walker in 1992 (U.S. Pat. No. 7,014,234), the disadvantages of Del Aqua's and Cain's are overcome, however this prior art from has a disadvantage caused by the non-standardized depth of twist locks used to connect containers together on ships.

It is common practice in container yards to simply stack containers in piles without securing them to one another, because it is not required by federal or state safety regulations. Additionally, equipment costs are prohibitive; cones are provided by vessels, not stevedoring companies or container yards. The additional labor required to set, lock and unlock connecting devices is also costly.

There are hazards inherent by not connecting the containers together while in a stacked configuration, such as building a disorderly pile. While one container is being added to a stack of containers, the container being stacked may nudge another container in the stack, causing it to fall. The fallen container may not be obvious to the operator of the lifting device. For obvious reasons, this is an extremely undesirable and dangerous situation, potentially causing great damage and injury.

As can be seen by existing solution attempts, the problem of providing a safe, economical, universal, and automatic means to secure containers has not been fully addressed. Existing methods can require placing humans in dangerous situations, require many costly parts, require manual locking and unlocking, and create disorderly piles.

What is needed is a locking device that can safely, securely, and automatically lock and unlock a container from a base quickly, requiring a minimum of direct human manipulation. What is also needed is a locking device that has no detached parts, eliminating that safety concern. What is additionally needed is a locking device that meets current safety standards and regulations. What is further needed, is a locking device that can be engaged on rail cars. What is again further needed is a locking device that does not excessively protrude into the interior cargo space of a container. What is still further needed is a locking device that can be automatically disengaged by the insertion of fork lift tines. What is again needed is a locking device that can enable the lifting of a container by just two of the four upper corner castings. What is also needed is a locking device that can be applied to existing modified containers, without the need to modify supporting equipment. What is finally needed is a locking device that provides a means to stack container in orderly and stable piles.

OBJECTS OF THE INVENTION

It is a general object of the present invention to provide a container locking device that can safely, securely, and automatically lock and unlock a container from a base quickly, requiring a minimum of direct human manipulation.

It is another object of the present invention to provide a container locking device that is integrated into existing container structure.

It is yet another object of the present invention to provide a container locking device that meets or exceeds current safety standards and regulations.

It is a further object of the present invention to provide a container locking device that can be engaged on ship decks, ship holds, rail cars, airplane cargo decks, truck chassis, other containers, and any number of other container transportation means.

It is yet a further object of the present invention to provide a container locking device that does not excessively protrude into the interior cargo space of a container.

It is another object of the present invention to provide a container locking device that can be automatically disengaged by the insertion of fork lift tines.

It is yet another object of the present invention to provide a container locking device that can enable the lifting of a container by just two of the four upper corner castings.

It is a further object of the present invention to provide a container locking device that can be applied to existing modified containers, without the need to modify supporting equipment.

It is also an object of the present invention to co-exist with current container securing equipment in the field.

It is yet a further object of the present invention to provide a container locking device that provides a means to stack containers in orderly and stable piles.

Other objects and features of advantages will become apparent as the specification progresses and from the claims.

SUMMARY

In accordance with the present invention, a system for locking and unlocking containers to transport modes and other containers is provided. The present invention is comprised of at least one actuating unit housed in the upper corner fitting of a container, a rotatable locking leg housed in a lower corner fitting of the container and a means to couple the actuating unit and the locking leg. Wherein, the twist lock of a lifting spreader engages the upper corner fitting of a container and therefore the actuating unit and urging the actuating unit in the upper corner fitting. The coupling means is pulled by the urging of the actuating unit, accordingly pulling the locking leg, causing it to rotate to an unlocked position. This corner fitting assembly can be installed on either one or all four corners of the container. The assembly can also be installed between upper and lower corner fittings on containers that have corner fittings between the ends of the containers such as but not limited to 45, 48 and 53 containers.

In an alternate embodiment, horizontal coupling means, couple the lower corner fittings together, so that if a single actuating unit is engaged by a lifting spreader twist lock, multiple locking legs in the lower corner fittings can simultaneously rotate into the unlocked position. At least one of the horizontal coupling means can intersect a tine well. The tension to the coupling means can either be imparted from the actuating unit located in the upper corner fitting, causing one or multiple locking legs to rotate to the unlocked position. Alternatively, if the tine of a fork lift or similar lifting vehicle is inserted into the tine well of the container, the tine will lift the horizontal coupling means intersecting the tine well, tensioning the coupling means, again causing one or multiple locking legs to rotate to the unlocked position.

In addition, the locking leg can be of many shapes and comprised of a single unit or multiple parts so long as the leg stays with the lower corner fitting when lifted by a lifting device, able to withstand the forces, dictated by international standards, to secure a container to its base and is able to mate with and rotate within bases such that when the locking leg is in a locked position the locking leg and access slot of the base are not aligned and therefore cannot separate.

The lower corner fitting can be a single unit or comprised of multiple parts as described in the drawings and text of this application, providing the lower corner fitting can house, support, and allow the locking leg to rotate.

To lock securely to a structure, the locking legs need to engage a base. A base is a vertically directed access slot in a surface such that a locking leg can mate with, rotate in, and lock to the underside of the access slot. For example, a square tube with access slots embedded into the surface of a container yard or access slots in the cargo deck of an aircraft could be a base. Additionally, access slots embedded in chassis or railcars can also be a base.

An alternate design is a base having slotted vertical access openings on both the ceiling and floor of the base such that the base can be used as an adapter to receive and lock to the male locking legs of the present invention and the twist lock devices currently used to lock containers to transport modes such as, but not limited to, chassis.

An additional advantage of the present invention is that a single device will be used to connect containers to bases. This will decrease the purchase and maintenance costs connected to cones and chassis twist locks; again decreasing costs to the transportation industry.

Embodiments of the present invention are directed to a shipping container locking system. The shipping container locking system includes an actuating unit housed in the interior space of the upper corner fitting of a shipping container. The actuating unit includes a cup and a swivel. The cup has an interior surface and a bottom surface. The cup is capable of rotating in a generally horizontal direction about the swivel. The shipping container locking system also includes a locking mechanism. The locking mechanism is partially housed in the interior space of the lower corner fitting of a shipping container. The locking mechanism includes an internal locking leg and a collar. The internal locking leg and collar each have an orifice formed therethrough. The locking mechanism also includes a locking leg shaft having a cylindrical section protruding through the orifice of the internal locking leg and collar. The locking leg shaft is connected to a locking leg having an elongated base. The shipping container locking system also includes a vertical coupler. The vertical coupler connects the actuating unit with the locking mechanism. The shipping container locking system also includes a return means. The return means communicates elastically between the locking leg shaft and the internal locking leg. The return means has a force that is applied about the central axis of the cylindrical section of the locking leg shaft. A torsional force can be applied to the actuating unit to cause rotation of the actuating unit about the swivel. The rotation of the actuating unit pulls and imparts a tension force on the vertical coupler. The tension force on the vertical coupler causes a movement of the vertical coupler. The movement of the vertical coupler imparts a torsional force on the locking mechanism to rotate the locking leg. The torsional force on the locking mechanism causes rotation of the locking mechanism.

According to one aspect of the invention, the return means imparts a torsional force about the central axis of the cylindrical section of the locking leg shaft.

Embodiments of the present invention are directed to an apparatus to unlock a container twistlock. The apparatus includes an actuating unit housed in an interior space of the upper corner fitting of a shipping container. The interior space includes a floor, walls and a ceiling. The actuating unit includes a cup and a swivel. The cup has an interior surface and a bottom surface. The cup is able to rotate in a generally horizontal direction about the swivel. The apparatus also includes a container locking mechanism generally housed in a lower corner fitting of the container. The apparatus also includes a vertical coupler. The vertical coupler connects the actuating unit to the locking mechanism. A torsional force can be applied to the actuating unit rotating the actuating unit about the swivel. The torsional force is converted to a tension force by the actuating unit. The tension force acts on the vertical coupler to cause a movement of the vertical coupler. The movement of the vertical coupler causes the container locking mechanism to rotate and unlock.

According to one aspect of the invention, the swivel protrudes in a generally perpendicular direction to the upper corner fitting.

According to another aspect of the invention, the cup rotates about the swivel in a generally horizontal plane.

According to another aspect of the invention, the vertical coupler has a first end connected to the cup and a second end connected to the locking mechanism. In some embodiments the cup rotation imparts a tension force on the vertical coupler.

According to another aspect of the invention, the tension force on the vertical coupler imparts a torsional force on the locking mechanism causing the locking mechanism to unlock.

According to another aspect of the invention, the swivel protrudes in a generally perpendicular direction from a base plate. The base plate has an upper surface and lower surface. The lower surface communicates in a generally horizontal plane with the floor of the corner fitting.

According to another aspect of the invention, the bottom surface of the cup communicates in a generally horizontal plane with the upper surface of the base plate.

According to another aspect of the invention, the actuating unit is installed in an existing interior space of an upper corner fitting of a container and the container locking mechanism is installed in an existing interior space of a lower corner fitting of a container.

All of the disadvantages of the prior art have been addressed by the present invention. As can be seen in the description, an automatic locking system for cargo containers that requires a minimum of direct human intervention is provided. No personnel is required to directly contact the container at any point during the loading and unloading process, saving both labor and time and reducing exposure to potentially unsafe situations. Additionally, no loose parts are required, reducing the chance of falling objects resulting in injury. The present invention also enables the industry to meet safety standards. A secondary safety related advantage of the present invention will be a decrease in the costs associated with on the job injuries that occur around container operations. These decreased costs will be realized by the transportation industry and ultimately consumers.

DESCRIPTION OF THE PREFERRED EMBODIMENTS

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
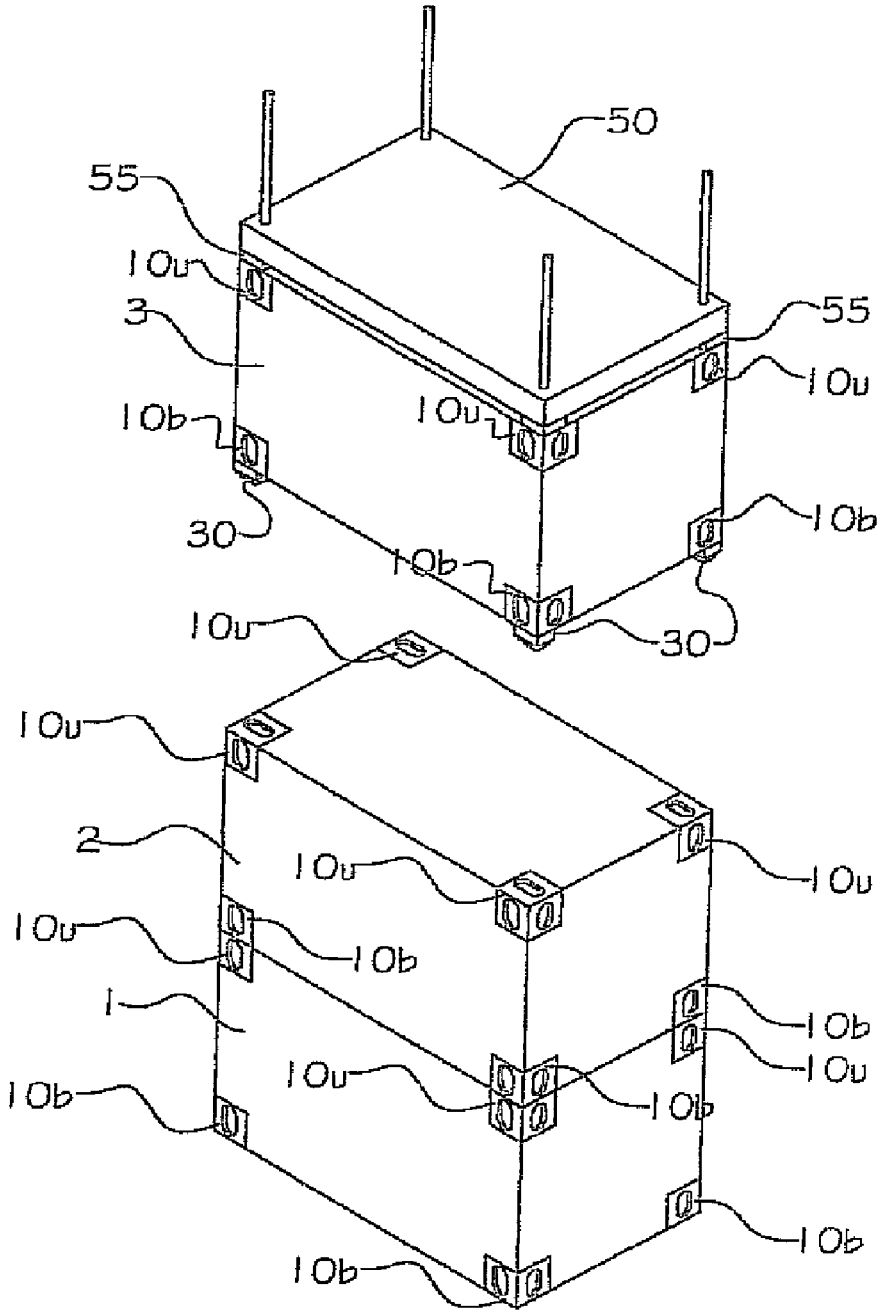
FIG. 1 is a perspective view of the present invention installed on a container, being stacked by a spreader.

As can be seen in FIG. 1, container 1 and container 2 are stacked, one on top of the other and a third container 3 is suspended above the stacked containers by a lifting spreader 50, in preparation to stack the third container 3. Each container has a total of eight corner fittings, four lower corner fittings 10*b* and four upper corner fittings 10*u* where the upper corner fittings 10*u* of the lower containers 1 serve as bases for the containers on top of them.

The four locking legs 30 of the third container 3 are aligned with the four corner fittings 10*u* of the upper stacked container 2. As the third container 3 is lowered onto the upper stacked container 2, the locking legs 30 are guided into the corner fittings 10*u*. The locking legs 30 of the third container 3 will return to a locked position when the lifting spreader 50 has lowered the third container 3 onto the upper stacked container 2 and disengages from the corner fittings 10*u* of the third container 3, causing the third container 3 to be locked to the now middle container 2. The third container 3 is then restricted in movement. This particular action of locking will be discussed in further detail in the proceeding description.

Figure 2:
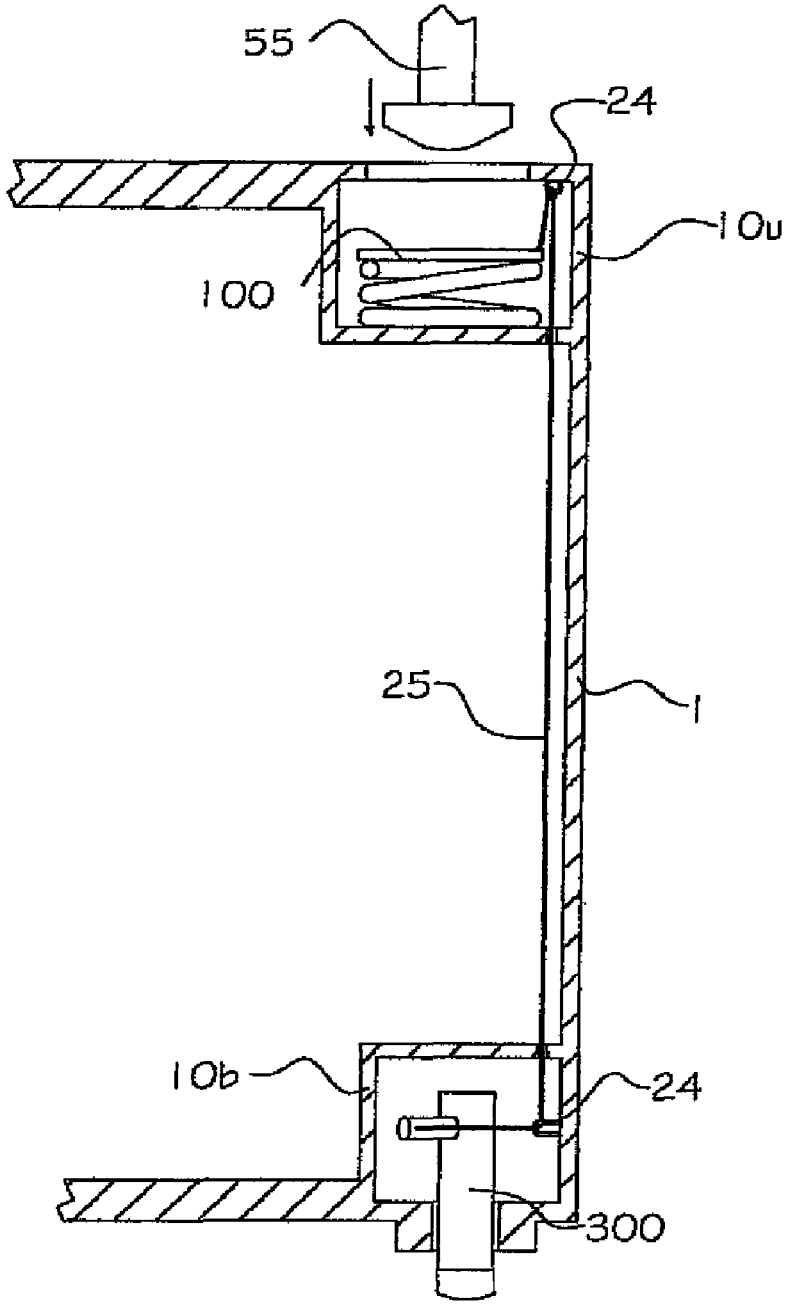
FIG. 2 is a cross-sectional side view of a cargo container, showing the present invention.

Looking more particularly at FIG. 2, a cutaway of a container more clearly illustrates the present invention. At least one of the upper corner fittings 10*u* houses an actuating unit 100 and a guiding eye 24. The guiding eye 24 can be any number of pivoting means enabling a change in the direction of a force applied to the vertical connecting line 25, such as a pulley, eyelet, or other similar devices. Additionally, the guiding eye 24 can be attached to the corner fitting 10*u* or to any other appropriate structure found within or around the container 1.

A vertical connecting line 25, having one end attached to the actuating means 100, runs through the guiding eye 24, pivoting down and exiting the upper corner fitting 10*u*. The vertical connecting line 25 traverses the height of the container, enters the lower corner fitting 10*b*, pivots at the second guiding eye 24, and is attached to a locking mechanism 300. The vertical coupling means 25 can be any number of translational coupling devices, such as a cable or a rigid coupler utilizing a mechanism other than the guiding eye 24.

Figure 6A:
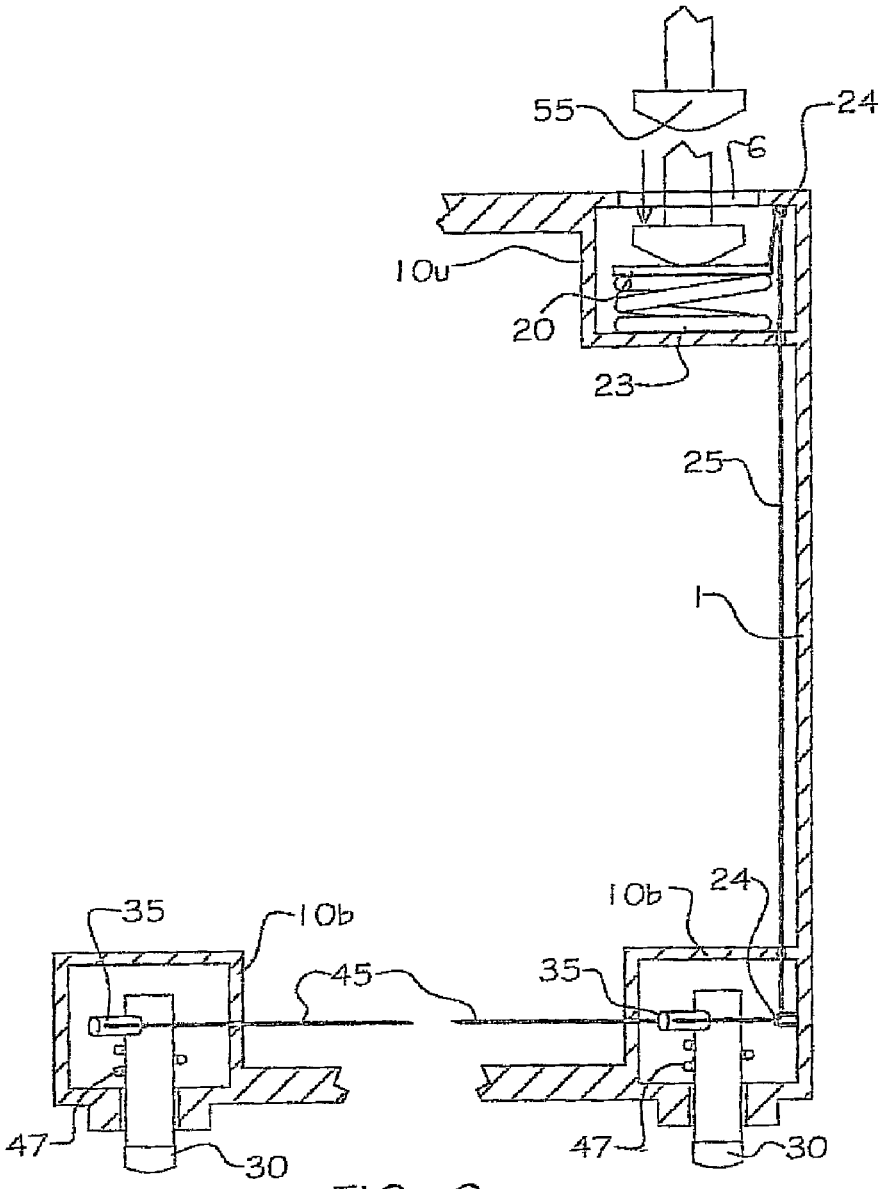
FIG. 6*a-b* are operational drawings of a spreader twist lock as it mates with an upper corner casting and causes locking legs of lower corner castings to rotate.
Figure 6B:
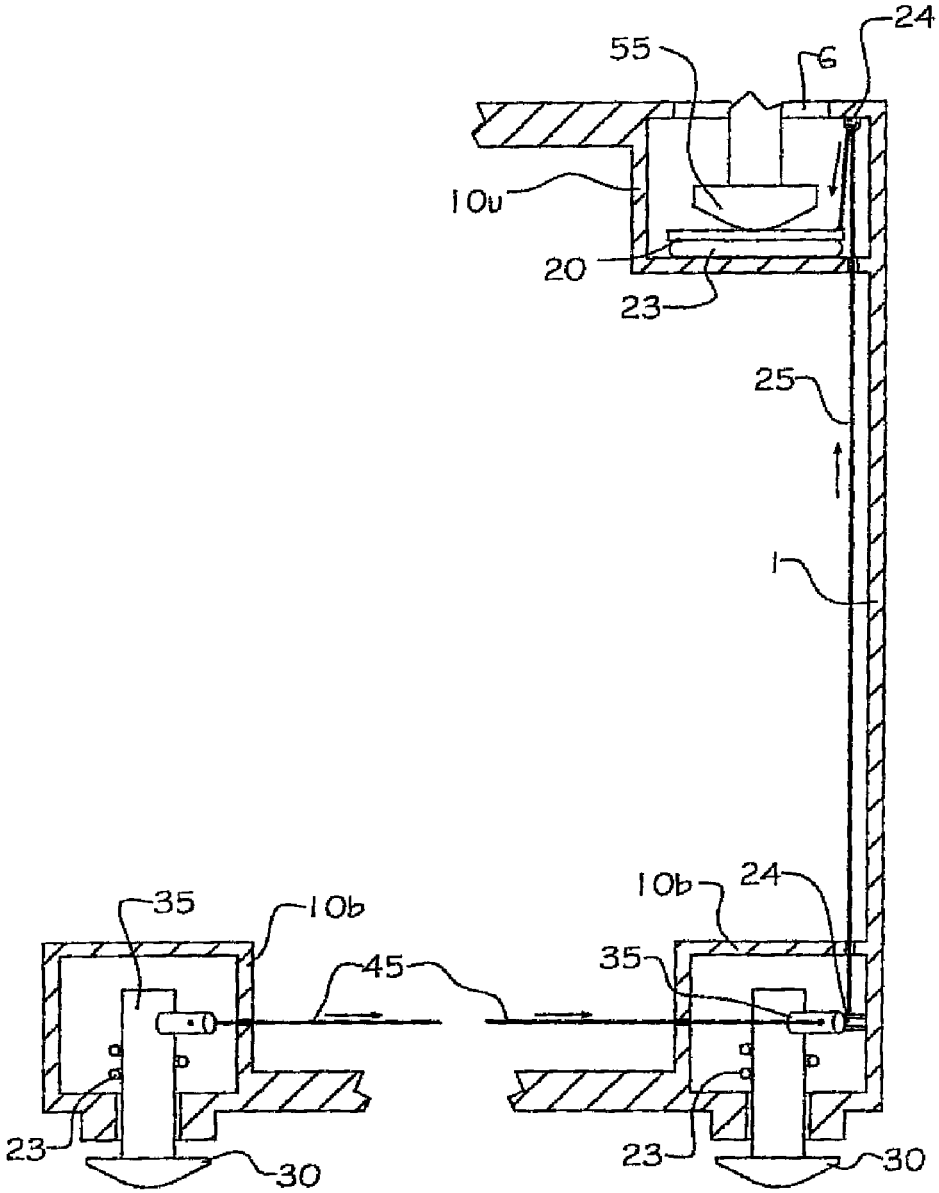

Still referring to FIG. 2, as the actuating unit 100 is engaged by a lifting spreader twist lock 55, the vertical coupling means 25 is pulled accordingly, pivoting at the upper guiding eye 24, and causing a general upward movement in the vertical coupling means 25. The vertical coupling means 25 is again pivoted at the lower guiding eye 24, and in turn, imparts a rotational motion to the locking mechanism 300, causing it to move into the unlocked position as can be seen in FIG. 6*a*. In a similar, but opposite manner, when the lifting spreader twist lock 55 disengages from the actuating unit 100 the tension on the vertical coupling means 25 is reduced, allowing a torsional return means 47 to impart a rotational motion on the locking mechanism 300, causing it to return to the locked position as is shown in FIG. 6*b*.

Figure 3A:
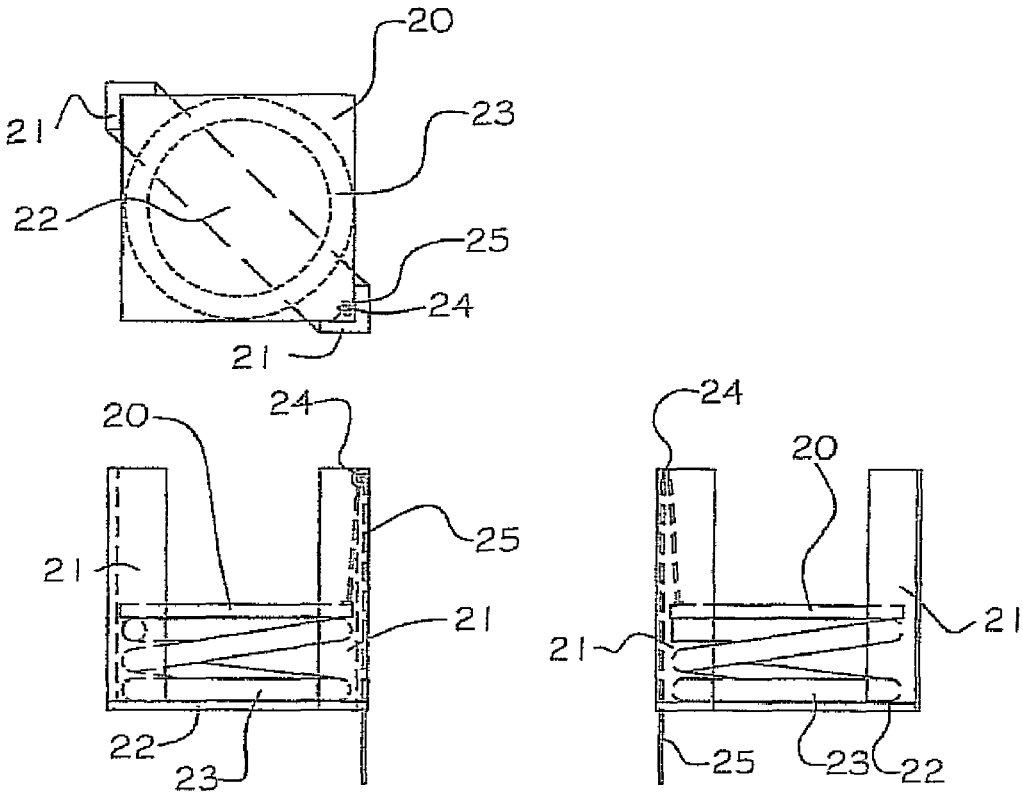
FIG. 3*a-d* views, of three embodiments of an actuating unit.

FIG. 3*a* shows one embodiment of an actuating unit 100 comprising a compression plate 20, compression plate guides 21, a base plate 22 and a torsional return means 23. When the lifting spreader twist lock 55 engages this embodiment of the actuating unit 100 the lifting spreader twist lock 55 forces the compression plate 20 and torsional return means 23 downward as is shown in FIG. 6*b*. The vertical coupling means 25 is pulled downward accordingly, pivoting at the guiding eye 24, and causing a general upward movement in the vertical coupling means 25 which causes the locking leg 30 of the locking mechanism 300 to rotate as is shown in FIG. 6*b*.

Figure 3B:
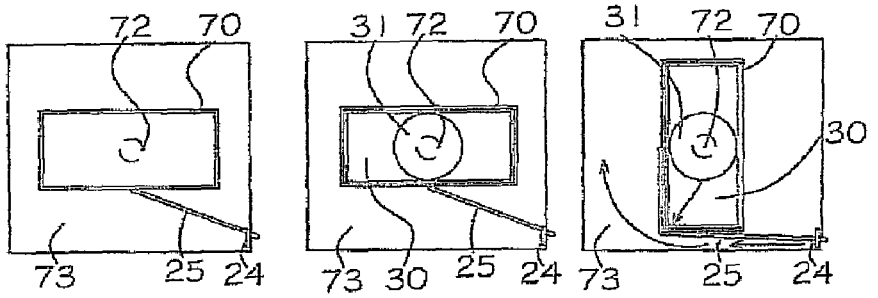
Figure 3B:
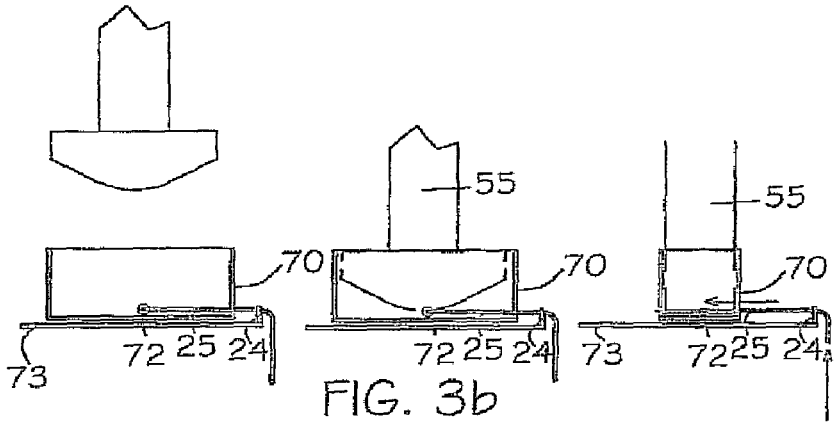

FIG. 3*b* shows a plan view and a side view of another embodiment of an actuating unit 100 comprising a cup 70 having walls and a floor, which rotates in a generally horizontal plane about a swivel 72. A lifting spreader twist lock 55 can fit within the walls of the cup 70 as is shown in FIG. 3*b*. The swivel 72 may be connected to a swivel base 73. The vertical connecting means 25 may be connected directly to the cup 70 or to a coupling means attachment means 35 extending in a generally horizontal plane from the cup 70. When the lifting spreader twist lock 55 engages this embodiment of the actuating unit 100 the lifting spreader twist lock 55 engages the cup 70 and as the lifting spreader twist lock 55 rotates, it causes the cup 70 to rotate, as is shown in FIG. 3*b*. The vertical coupling means 25 is pulled accordingly, pivoting at the guiding eye 24, and causing the locking leg 30 of a locking mechanism 300 to rotate as is shown in FIG. 6*b*.

Figure 3C:
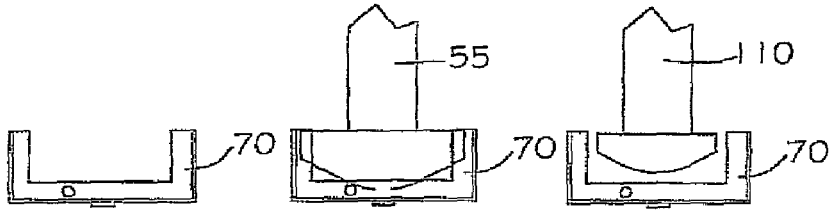

Another embodiment of the cup 70 is shown in FIG. 3*c*. In FIG. 3*b*, the embodiment of the cup 70 shows the walls of the cup 70 to be solid; in FIG. 3*c*, the walls of the cup 70 are partial.

Figure 3D:
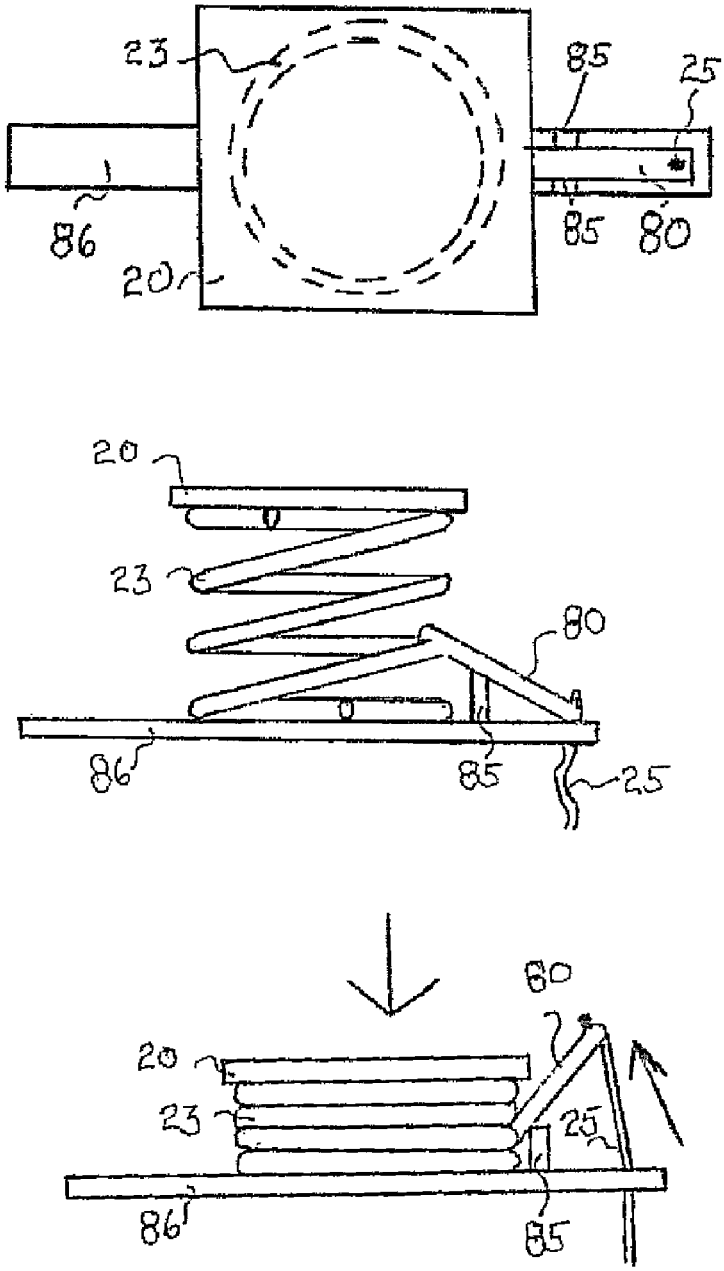

A third embodiment of an upper actuating unit 100 is shown in FIG. 3*d*. This embodiment includes a lever 80, having one end coupled with the vertical coupling means 25. The lever 80 pivots over a fulcrum 85 when the torsional return means 23 is compressed, causing a generally upward movement of the vertical coupling means 25 which causes the locking leg 30 of a locking mechanism 300 to rotate as is shown in FIG. 6*b*. The fulcrum 85 maybe connected to a fulcrum base 86.

Figures 4A, 4B:
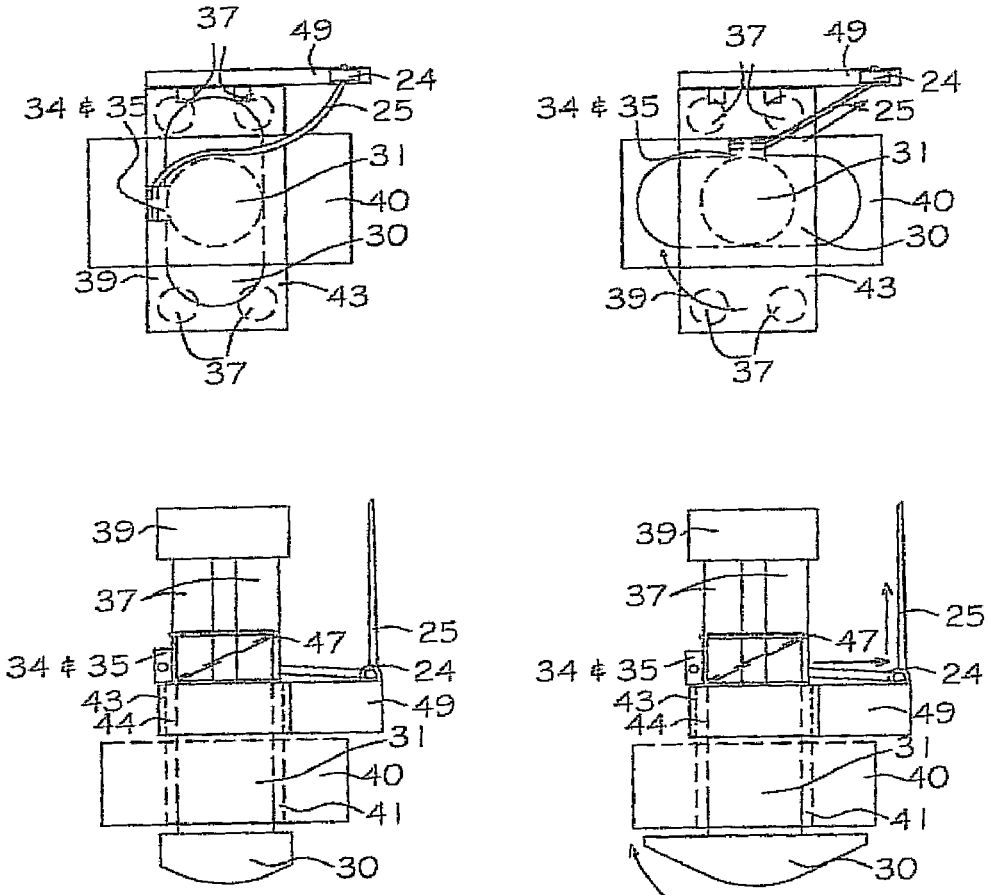
FIG. 4*a-h* are views of one embodiment of a locking mechanism.

FIGS. 4*a*-4*b* shows a top view and side view of one embodiment of a locking mechanism 300. The drawing illustrates a locking leg 30 having a locking leg shaft 31. The locking leg shaft 31 protrudes through a collar 40 having a collar orifice 41 and an internal locking leg 43 having an internal locking leg well 44. The locking leg shaft 31 protrudes above the internal locking leg 43 where a vertical slippage prevention means 34 holds the locking leg 30 in the assembly. The vertical slippage prevention means can also act as a coupling means attachment means 35. A torsional return means 47 applies a force to the locking leg shaft 31. Spacers 37 and a top bar 39 may also be connected to the internal locking leg 43 as shown to fill the vertical void inside the lower corner fitting 10*b* of a container 1. A guiding eye 24 is a part of the guiding eye attachment means 49 which is connected to the internal locking leg 43. When the vertical coupling means 25 enters the lower corner fitting 10*b* of a container it can pass through the guiding eye 24 and can be connected to the locking leg shaft 31 as illustrated in this embodiment by being secured to the coupling means attachment means 35. The coupling means attachment means 35 can also be used to connect horizontal coupling means 45 to locking legs 30 as is shown in FIGS. 6*a*-6*b*. As discussed above, when an actuating unit 100 is engaged, a force is applied to the vertical coupling means 25. This force causes the locking leg shaft 31 and therefore the locking leg 30 to rotate, as is demonstrated in FIGS. 6*a*-6*b*. When the locking leg shaft 31 rotates to a position that aligns the locking leg 30 with vertically directed access slots 6, the container can be hoisted clear of the vertically directed access slot 6. Additionally, when the actuating unit 100 is disengaged, a torsional return means 47 will cause the locking leg shaft 31 and the locking leg 30 to rotate so that the locking leg 30 no longer aligns with the vertically directed access slots 6 thereby securing the container to a new base 5.

Figure 4C:
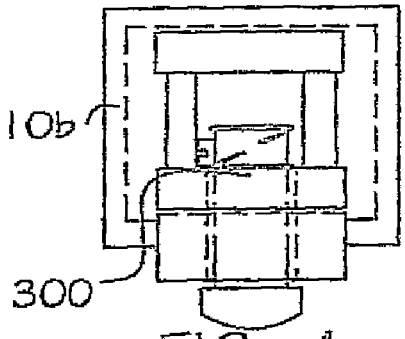
Figure 4D:
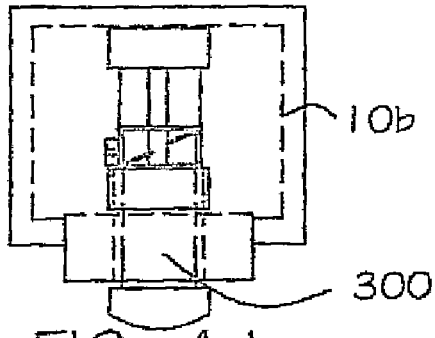
Figure 4E:
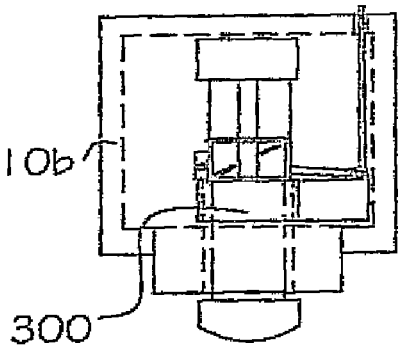
Figure 4F:
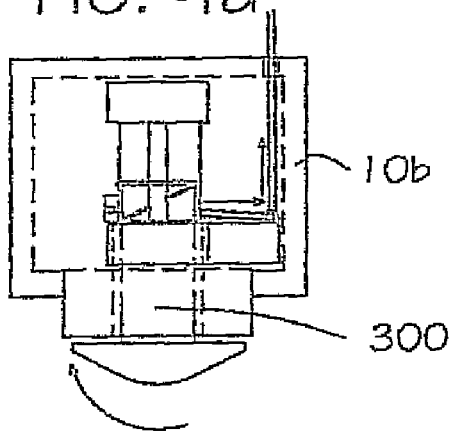

FIGS. 4*c*-4*f* illustrate how the above described embodiment of a locking mechanism 300 can be inserted into a lower corner fitting 10*b* and can be connected to a vertical coupling means 25. In FIG. 4*c* the internal and external components are aligned with the access slot 6 of the lower corner fitting 10*b* and inserted. In FIG. 4*d* the internal assembly is rotated around the locking leg shaft 31, thereby securing the locking mechanism 300 within the interior volume of the lower corner fitting 10*b*. FIGS. 4*e*-4*f* illustrate how the vertical coupling means 25 connects to the locking mechanism 300 and can cause the locking leg 30 to rotate.

Figure 4G:
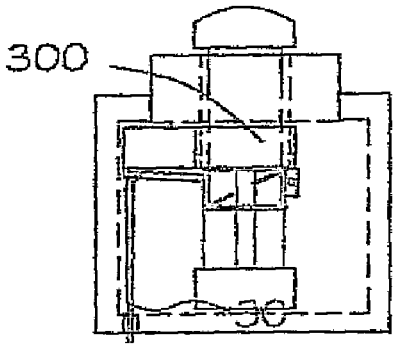
Figure 4H:
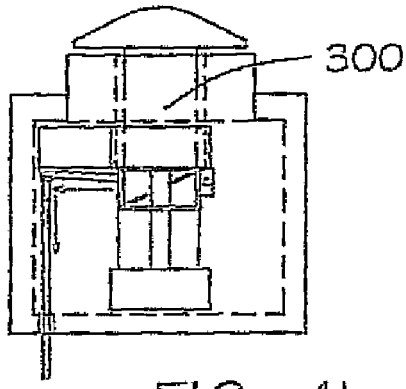

FIGS. 4*g*-4*h* demonstrate how the locking mechanism 300 can be used as a locking mechanism in an upwardly facing access slot 6 such as when a corner fitting type device is utilized to secure containers to chassis, railroad cars or terminal decks.

Figure 5A:
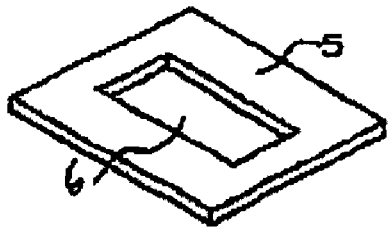
FIG. 5*a-c* are perspective views of a base.
Figure 5B:
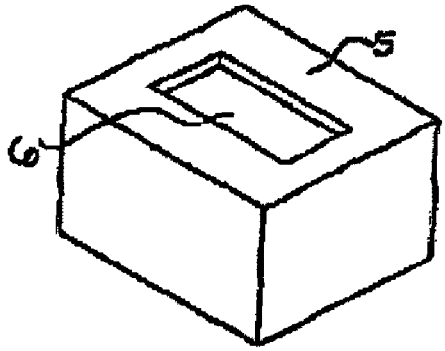
Figure 5C:
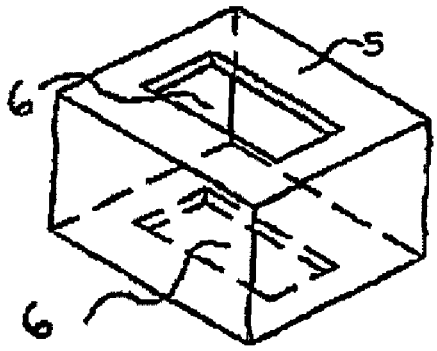

Referring to FIGS. 5*a*-5*c*, various bases 5 can be seen. Each variation of the base 5 has at least one vertically directed access slot 6 to receive a locking leg 30 of the present invention. A variety of base 5 designs may be utilized embodying the basic principal of the disclosed design. These bases 5 may be installed on ship decks, cargo holds, truck chassis, train cars, or wherever necessary.

As can be seen in FIG. 6*a*, a lifting spreader twist lock 55 is prepared to engage the upper corner fitting 10*u* of the container 1, through the vertically directed access slot 6. As described previously, a vertical coupling means 25 couples the compression plate 20 with the coupling means attachment means 35. The horizontal coupling means 45 couples a first lower corner fitting 10*b* with an adjacent lower corner fitting 10*b* on the same container 1. It can be seen that a torsional movement of the locking leg 30 of the first corner fitting 10*b* will impart a rotation on the second locking leg 30 located in an adjacent lower corner fitting 10*b*. When the lifting spreader twist lock 55 is disengaged from the upper corner fitting 10*u* of the container 1, the load is lifted from the compression plate 20, and the downward tension is reduced, allowing a torsional return means 47 to impart a rotational motion on the locking leg 30, causing it to be returned to the locked position.

Looking at FIG. 6*b*, a lifting spreader twist lock 55 is engaged in the upper corner fitting 10*u* of container 1, though the vertically directed access slot 6. The compression plate 20 is depressed and, in a manner previously described, imparts a rotational motion on the locking leg 30 of the first lower corner fitting 10*b*, causing it to move into the unlocked position. The horizontal coupling means 45, as a result, is tensioned, thus imparting a rotation on the second locking leg 30 located in another lower corner fitting 10*b* of container 1, causing it to be moved into the unlocked position. In this way, a single actuating unit 100 can cause multiple locking legs 30 of the corner fitting 10*b* located at each corner of the container 1 to move simultaneously into the locked or unlocked position.

While the present invention has been described with regards to particular embodiments, it is recognized that additional variations of the present invention may be devised without departing from the inventive concept.

What is claimed is:

1. A shipping container locking system comprising:

an actuating unit housed in an interior space of an upper corner fitting of a shipping container, said actuating unit comprising a cup and a swivel, said cup having an interior surface and a bottom surface, said cup being capable of rotating in a generally horizontal direction about said swivel;

a locking mechanism, said locking mechanism being partially housed in an interior space of a lower corner fitting of a shipping container and said locking mechanism comprising an internal locking leg and a collar, each having an orifice formed therethrough, said locking mechanism also comprising a locking leg shaft having a cylindrical section protruding through said orifice of said internal locking leg and collar and being connected to a locking leg having an elongated base;

a vertical coupler, said vertical coupler connecting said actuating unit with said locking mechanism;

a return means, said return means communicating elastically between said locking leg shaft and said internal locking leg, said return means having a force that is applied about a central axis of the cylindrical section of said locking leg shaft;

wherein a torsional force can be applied to said actuating unit to cause rotation of said actuating unit about said swivel;

wherein the rotation of said actuating unit pulls and imparts a tension force on said vertical coupler;

wherein the tension force on said vertical coupler causes a movement of the vertical coupler;

wherein the movement of said vertical coupler imparts a torsional force on the locking mechanism to rotate the locking leg; and wherein the torsional force on the locking mechanism causes rotation of the locking mechanism.

2. The shipping container locking system of claim 1, wherein said swivel protrudes in a generally perpendicular direction to said upper corner fitting.

3. The shipping container locking system of claim 1, wherein said cup rotates about said swivel in a generally horizontal plane.

4. The shipping container locking system of claim 1, wherein said vertical coupler has a first end connected to said cup and a second end connected to said locking mechanism.

5. The shipping container locking system of claim 4, wherein rotation of said cup imparts a tension force on said vertical coupler.

6. The shipping container locking system of claim 1, wherein tension force on said vertical coupler imparts a torsional force on said locking mechanism causing said locking mechanism to unlock.

7. The shipping container locking system of claim 1, wherein said swivel protrudes in a generally perpendicular direction from a base plate, said base plate having an upper surface and lower surface, said lower surface communicating in a generally horizontal plane with a floor of said upper corner fitting.

8. The shipping container locking system of claim 1, wherein said bottom surface of said cup communicates in a generally horizontal plane with an upper surface of a base plate.

9. The shipping container locking system of claim 1, wherein said return means imparts a torsional force about the central axis of the cylindrical section of said locking leg shaft.

10. The shipping container locking system of claim 1, wherein the actuating unit is installed in an existing interior space of an upper corner fitting of a container and the container locking mechanism is installed in an existing interior space of a lower corner fitting of a container.

11. An apparatus to unlock a container twistlock comprising:

an actuating unit housed in an interior space of an upper corner fitting of a shipping container, said interior space comprising a floor, walls and a ceiling, said actuating unit comprising a cup and a swivel, said cup having an interior surface and a bottom surface, said cup being able to rotate in a generally horizontal direction about said swivel;

a container locking mechanism generally housed in a lower corner fitting of the container; and a vertical coupler, said vertical coupler connecting said actuating unit to said locking mechanism;

wherein a torsional force can be applied to said actuating unit rotating the actuating unit about said swivel;

wherein said torsional force is converted to a tension force by said actuating unit, said tension force acting on said vertical coupler to cause a movement of said vertical coupler;

wherein the movement of said vertical coupler causes the container locking mechanism to rotate and unlock.

12. The apparatus to unlock a container twistlock of claim 11, wherein said vertical coupler has a first end connected to said cup and a second end connected to said locking mechanism.

13. The apparatus to unlock a container twistlock of claim 12, wherein rotation of said cup imparts the tension force on said vertical coupler.

14. The apparatus to unlock a container twistlock of claim 11, wherein the tension force on said vertical coupler imparts a torsional force on said locking mechanism causing said locking mechanism to unlock.

15. The apparatus to unlock a container twistlock of claim 11, wherein said swivel protrudes in a generally perpendicular direction from a base plate, said base plate having an upper surface and lower surface, said lower surface communicating in a generally horizontal plane with said floor of said upper corner fitting.

16. The apparatus to unlock a container twistlock of claim 11, wherein said bottom surface of said cup communicates in a generally horizontal plane with an upper surface of a base plate.

17. The apparatus to unlock a container twistlock of claim 11, wherein said swivel protrudes in a generally perpendicular direction to said upper corner fitting.

18. The apparatus to unlock a container twistlock of claim 11, wherein said cup rotates about said swivel in a generally horizontal plane.

19. The apparatus to unlock a container twistlock of claim 11, wherein the actuating unit is installed in an existing interior space of an upper corner fitting of a container and the container locking mechanism is installed in an existing interior space of a lower corner fitting of a container.

* * * * *